United States Patent [19]

Rowley

[11] 3,961,709

[45] June 8, 1976

[54] END RESTRAINT FOR SHIPPING BINS

[75] Inventor: James R. Rowley, Freeport, Pa.

[73] Assignee: PPG Industries, Inc., Pittsburgh, Pa.

[22] Filed: July 15, 1974

[21] Appl. No.: 488,346

[52] U.S. Cl. ..... 206/448; 105/486; 206/454; 211/51

[51] Int. Cl.[2] ..... B65D 85/48

[58] Field of Search ..... 105/367, 474, 486; 206/448–454; 211/49 R, 51; 214/7, 10.5 D; 248/119 R

[56] References Cited

UNITED STATES PATENTS

| | | | |
|---|---|---|---|
| 1,833,764 | 11/1931 | Tremblay et al. | 105/496 |
| 2,331,416 | 10/1943 | Muller, Sr. | 105/367 |
| 3,147,715 | 9/1964 | Myers | 105/367 |
| 3,754,516 | 8/1973 | Van Gompel | 105/496 |
| 3,791,311 | 2/1974 | Loomis | 105/376 X |
| 3,809,234 | 5/1974 | Kurick | 206/448 |

*Primary Examiner*—Steven E. Lipman
*Attorney, Agent, or Firm*—Donald Carl Lepiane

[57] ABSTRACT

End restraints for article shipping bins each include a rigid plate pivotally mounted on a carriage for movement toward and away from sides of the articles. Biasing facilities act on the carriage to (I) maintain the plate in contact with the sides of the articles; (2) limit longitudinal motion of the articles; and (3) dampen longitudinal forces acting on the articles during transit.

11 Claims, 4 Drawing Figures

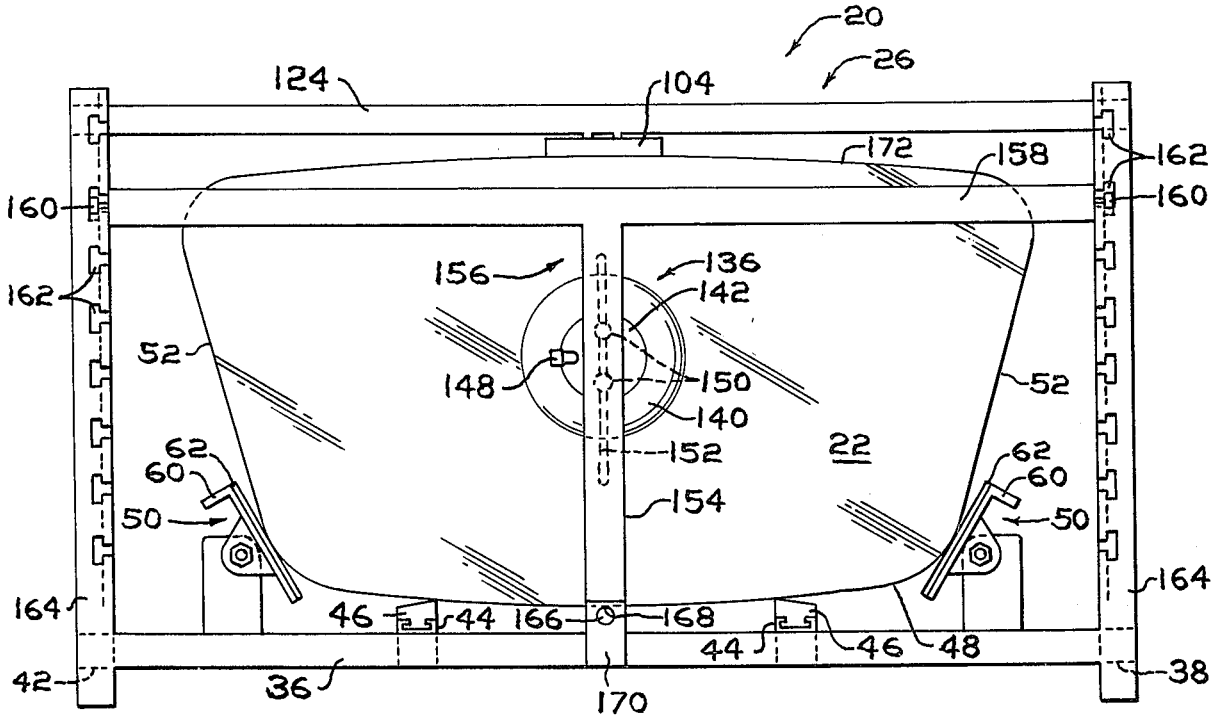
FIG. 2
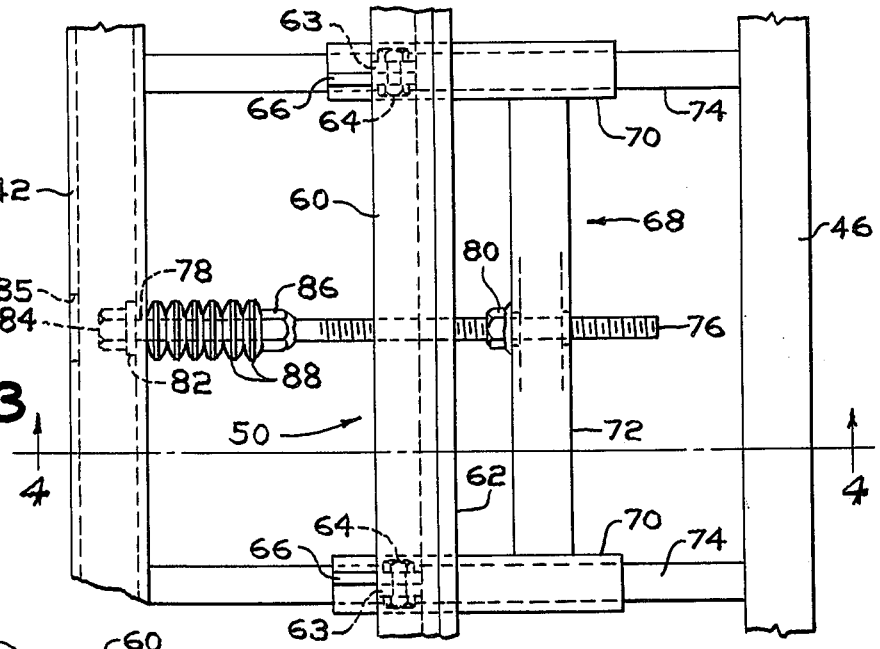
FIG. 3
FIG. 4
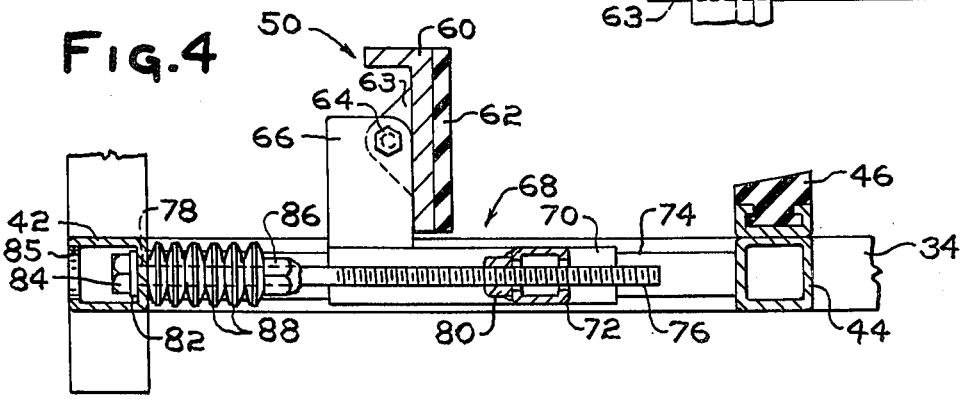

END RESTRAINT FOR SHIPPING BINS

CROSS REFERENCE TO RELATED APPLICATIONS

The front restraints disclosed in U.S. patent application Ser. No. 488,851 filed even date in the names of James R. Rowley and Walter E. Pater and entitled "Front Restraint Device For Shipping Bins" and disclosed in U.S. patent application Ser. No. 371,912 filed June 20, 1973, in the names of James R. Rowley and Walter E. Pater and entitled "Method of and Device for Restraining Movement of Articles During Transit" may be used with the end restraints of the invention, and the adjustable back support disclosed in U.S. patent application Ser. No. 488,347 filed even date in the name of James R. Rowley and entitled "Adjustable Back Support For Shipping Bins" may be used with the end restraint of the invention. The teachings of the above-mentioned applications are hereby incorporated by reference.

BACKGROUND OF THE INVENTION

1. Field of the Invention.

This invention relates to an end restraint used on bins for shipping articles, e.g., glass sheets, automotive backlites, automotive windshields or automotive sidelights, and more particularly, to end restraints for preventing longitudinal motion and dampening longitudinal forces acting on the articles during transit.

2. Discussion of the Technical Problems.

Articles, e.g., glass sheets, automotive backlites, automotive windshields, or automotive sidelights are normally shipped to automotive manufacturers in bins or racks.

During shipment, e.g., by rail car or truck, the articles in the bins are subjected to transportation forces. For example, the articles are subjected to longitudinal forces which act to move the articles toward and away from the sidewalls of the bin, i.e., along a longitudinal reciprocating path.

These forces which act on the articles are caused by the motion of the rail car or truck as it moves along the rails or road respectively. As can be appreciated by those skilled in the art, the longitudinal forces can damage the articles, especially glass articles, during transit making them unusable.

In general, to prevent damage to the articles, e.g., automotive backlites, during shipping, the backlites are normally loaded in a bin in a vertical position with an edge of the backlites resting on a resilient pad and tilted toward the back wall of the bin for packing stability. The backlites are secured in the bin with restraint devices.

To minimize and/or cancel longitudinal forces of the backlites during transit, dunnage, e.g., pieces of wood and corrigated cardboard are secured between the sides of the backlites and the sidewalls of the bin. This is undesirable because (1) after the bin is unloaded, the dunnage has to be disposed of creating a solid waste problem and (2) the dunnage becomes compressed during transit by the longitudinal forces moving the sides of the backlites against the dunnage thereby increasing the longitudinal reciprocating path. When this occurs, the backlites travel along an increased longitudinal reciprocating path thereby increasing the probability of damaging the sides of the backlites.

It would be advantageous, therefore, if end restraints for shipping articles were available that did not have the drawbacks or limitations of the prior art. More particularly, it would be advantageous to provide a bin with an end restraint system that eliminated the solid waste disposal problem and do not compress to increase the longitudinal reciprocating path.

SUMMARY OF THE INVENTION

This invention relates to an end restraint, e.g., an end restraint that may be used with article shipping bins of the type having a base and back wall. A carriage having a plate is mounted on guide rails for movement in a first direction, e.g., toward the article and in a second direction, e.g., away from the articles. Facilities are provided for moving the carriage in the first direction to a selected one of a plurality of positions, e.g., to move the plate into engagement with the article and in a second direction. Dampening and urging facilities are provided for (1) dampening forces acting on the plate to move the carriage in the second direction from the one of the plurality of positions and (2) urging the carriage in the first direction toward the one of the plurality of positions.

The invention also relates to a method of dampening longitudinal forces acting on articles during transit. The method includes the steps of moving a carriage having a plate toward the article in a first direction to move the plate into engagement with the article and dampening the forces applied to the plate to move the plate and carriage in a second direction opposite to the first direction, thereafter, urging the carriage in the first direction to maintain the plate in contact with articles.

BRIEF DESCRIPTION OF THE DRAWING

FIG. 2 is a front view of the bin of FIG. 1 loaded with automotive backlites;

FIG. 3 is a fragmented top view of the left side of the bin of FIG. 1 showing the left end restraint incorporating features of the invention; and FIG. 4 is a view taken along lines 4—4 of FIG. 3.

DESCRIPTION OF THE INVENTION

Figure 1:
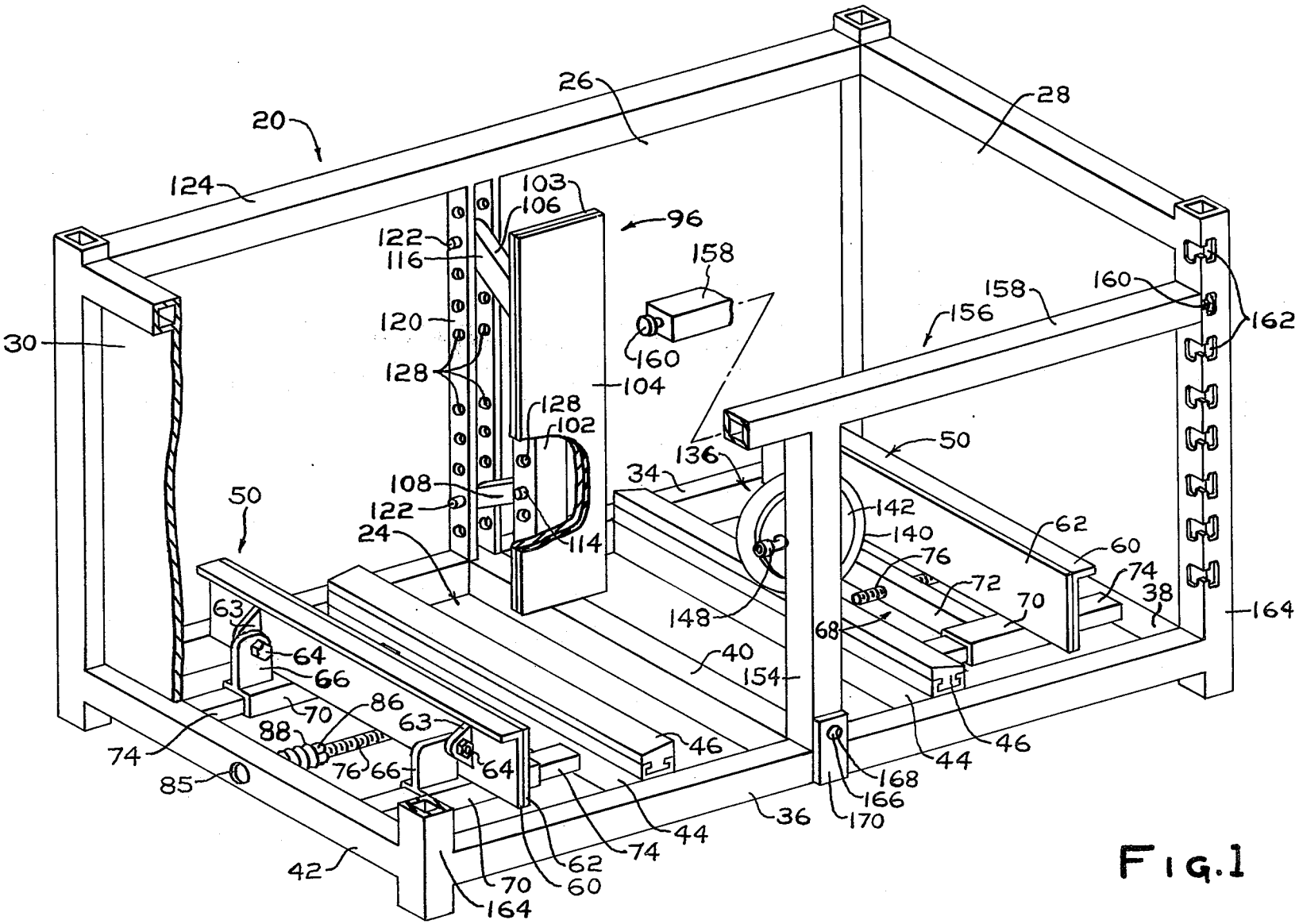
FIG. 1 is an isometric view of a bin having portions removed for purposes of clarity and having end restraints incorporating features of the invention.

In general, the invention relates to end restraints that may be used with article shipping bins. Referring to FIG. 1, there is shown a bin 20 used for transporting articles 22 (shown in FIG. 2) for example, glass plates, automotive backlites, automotive sidelights, or automotive windshields incorporating features of the invention. In general, the bin 20 includes a base 24, a back wall 26, a right and left sidewall 28 and 30 respectively as viewed in FIG. 1 secured together to define the bin 20 having an ingress end.

Certain terms which will be used herein are now defined for purposes of clarity. "Longitudinal motion of the articles" as the term is used herein, is the motion of the articles along a longitudinal reciprocating path. "Longitudinal reciprocating path" as the term is used herein is the motion of the articles toward and away from the sidewalls of the bin. "Longitudinal forces" as the term is used herein are the forces acting on the articles which impart longitudinal forces to the articles to move them along the longitudinal reciprocating path. "Oscillatory motion of the articles" as the term is used herein is the motion of the articles along an oscillatory reciprocating path. "Oscillatory reciprocating path" as the term is used herein is a path subtended by the articles as they pivot about a bottom edge toward and away from the back wall of the bin. "Oscillatory forces" as the term is used herein are the forces acting on the articles which imparts oscillatory forces to the articles to move them along the oscillatory reciprocating path. "Lateral motion of the articles" as the term is used herein is the motion of the articles along a lateral reciprocating path. "Lateral reciprocating path" as the term is used herein is the motion of the articles toward and away from the back wall of the bin. "Lateral forces" as the term is used herein are the forces acting on the articles which imparts lateral forces to the articles to move them along the lateral reciprocating path. The longitudinal, lateral and oscillatory forces which are known as transportation forces are generated by the acceleration, deceleration or swaying motion of the truck or rail car.

The base 24, in general, is defined by a pair of spaced rigid longitudinal members 34 and 36 interconnected to a right lateral member 38, a center lateral member 40, and a left lateral member 42. A pair of stationary runners 44 each having a resilient pad 46 for supporting the articles on an edge 48 (shown in FIG. 2) is secured between the longitudinal members 34 and 36.

An end restraint 50 incorporating features of the invention is provided adjacent each one of the sidewalls 28 and 30 for engagement with the sides 52 of the articles (shown in FIG. 2) to prevent or minimize longitudinal motion and to dampen longitudinal forces of the articles during transit.

With continued reference to FIG. 1, the end restraint 50 on the right and left side of the bin as viewed in FIG. 1 are identical in construction; therefore, the end restraint of the left side of the bin 20 as viewed in FIG. 1 will be discussed for purposes of simplicity with the understanding that the discussion is also applicable to the end restraint on the right side of the bin unless indicated otherwise.

With reference to FIGS. 3 and 4, the end restraint 50 includes a rigid plate 60 having a resilient pad 62 on one surface. In the preferred embodiment, the plate 60 has an inverted "L" shape (shown better in FIG. 4) for added rigidity. A pair of spaced plates 63 are provided on the opposed surface of the plate 60 to pivotally mount the plate 60 at 64 to each one of a pair of uprights 66 of a movable carriage 68. The plate 60 is pivotally mounted to seat against the sides 52 of the articles and the resilient pad 62 prevents marring of the sides 52 of the articles (see FIG. 2).

The carriage 68 further includes a pair of sleeves 70 securely connected to the uprights 66 and interconnected by a rigid member 72 for simultaneously moving the sleeves 70 and end restraint 50 toward and away from the sides 52 of the articles on guide rails 74.

With reference to FIG. 1, the guide rails 74 on the left side of the bin are securely mounted in any conventional manner between the lateral member 42 and adjacent stationary runner 44. The guide rails 74 on the right side of the bin as viewed in FIG. 1 are securely mounted in any conventional manner between the lateral member 38 and the adjacent stationary runner 44.

Referring back to FIGS. 3 and 4, a threaded shaft 76 having one end 78 freely mounted in the lateral member 42, passes through nut 80 securely mounted on the rigid member 72 and through the rigid member 72. The end 78 of the shaft has a washer 82 and a nut 84 securely mounted thereto to (1) prevent movement of a shaft 76 toward adjacent runner 44; and (2) rotate the shaft to move the carriage 68 and end restraint 50 toward and away from the side of the articles respectively. A hole 85 is provided in the lateral member 38 and 42 for access to the nut 84.

A nut 86 is securely mounted on the shaft 76 between the rigid member 72 of the carriage 68 and the lateral member 42. A spring 88 is provided on the shaft 76 between the nut 86 and cross member 42 to provide facilities to (1) bias the end restraint toward the sides 52 of the articles (see FIG. 2); (2) prevent longitudinal motion of the articles during transit; and (3) dampen longitudinal forces of the articles during transit. The spring 88 may be a coiled spring or a plurality of disc springs.

The biasing action of the spring 88 of the end restraints should be sufficient to maintain the sides of the articles in alignment and to dampen longitudinal forces acting on the articles to move them along the longitudinal reciprocating path. In general, for each English ton of article weight the biasing action of the spring, i.e., the force of the spring 88, should be about 10,000 pounds (about 4,500 kilograms) at 75% deflection of the springs to dampen longitudinal forces acting on the articles. At 75% deflection, the springs have 25% deflection left before the springs lose their dampening effect.

In practice, after the articles are loaded in the bin 20, the shaft 76 is rotated in a first direction to move the end restraint 50 into engagement with the side 52 of the articles. The spring 88 maintains the carriage 68 and end restraints 50 against the sides 52 of the articles to prevent longitudinal motion of the articles along the longitudinal reciprocating path. When the longitudinal forces exceed the biasing action of the spring 88, e.g., the spring 88 on the left side of the bin, as viewed in FIG. 1, the articles move toward the left side of the bin. Movement of the articles toward the left side compresses the spring between the nut 86 on the shaft 76 and the lateral member 42. The spring 88 compresses until the biasing action of the spring exceeds the longitudinal forces acting on the articles. The spring thereupon acts to move the carriage 68 and end restraint 50 away from the left sidewall 30 moving the articles toward the right sidewall 28 against the right end restraint 50. The right end restraint 50 responds to the movement of the articles in a similar manner as the left end restraint when the articles moved toward the left sidewall. In this manner, the longitudinal forces acting on the articles are dampened as the articles move along the longitudinal reciprocating path.

Normally, the articles 22 are tilted toward the back wall 26 on a back support 96 to provide packing stability and to minimize swaying, e.g., small oscillatory forces imparted to the articles during transit.

The tilting of the articles may be accomplished in any conventional manner. Disclosed in U.S. patent application Ser. No. 488,347 filed even date in the name of James R. Rowley and entitled "Adjustable Back Support For Shipping Bins" there is disclosed the adjustable back support member 96 that may be used with the present invention.

With reference to FIG. 1, the back restraint member 96, in general, includes a generally U-shaped member 102. A rigid plate 103 is securely joined to the U-shaped member 102. A resilient pad 104 is advantageously secured to outer surface of the plate 103 to prevent marring of the surface of the article in contact therewith and to dampen oscillatory and lateral forces of the articles as the articles move toward the back wall of the bin. A top strut 106 and a bottom strut 108 are each pivotally mounted at one end to the U-shaped member 102 by way of pins 114. Each strut 106 and 108 is mounted at their other end to a U-shaped channel member 120 by way of pins 122.

The U-shaped channel member 120 is securely mounted between the longitudinal member 34 and longitudinal member 124 of the back wall 26. To provide for various adjustments of the back support member 96, the U-shaped member 102 and U-shaped channel member 120 are advantageously provided with a plurality of holes 128.

By selectively positioning the struts 106 and 108, the back support member 96 may be (1) tilted at any angle to support the articles and (2) spaced at any lateral distance from the back wall to accommodate partial loads and accommodate various patterns. Preferably, the angle of tilt is approximately 5° from a line normal to the base 24 of the bin 20.

With reference to FIGS. 1 and 2, a front restraint device 136 (1) secures the articles in the bin as a unitized pack; (2) limits oscillatory and lateral motions of the articles during transit; and (3) dampens oscillatory and lateral forces of the articles as the articles move along the oscillatory and lateral paths during transit.

The front restraint device may be of the type known in the prior art, e.g., the restraint device disclosed in U.S. patent application Ser. No. 371,912 filed on June 20, 1973, in the names of James R. Rowley and Walter E. Pater and entitled "Method of and Device For Restraining Movement of Articles During Transit" or of the type disclosed in U.S. patent application Ser. No. 488,851 filed even date in the names of James R. Rowley and Walter E. Pater and entitled "Front Restraint Device For Shipping Bins". Shown in FIGS. 1 and 2 is the pneumatic front restraint device disclosed in the above-mentioned U.S. patent application filed even date.

In general, and with reference to FIGS. 1 and 2, the pneumatic restraint device 136 includes an inflatable member 140 having a rigid pad 142 mounted on one surface. A rigid pad and a resilient pad (not shown) are advantageously mounted on the opposite surface of the inflatable member. The inflatable member 140 is inflated and deflated by way of a valve 148 which is advantageously mounted on the rigid pad 142.

With reference to FIG. 2, the pneumatic restraint device 136 is mounted at the ingress end of the bin 20 by providing a pair of headed studs 150 on the rigid pad 142 of the restraining device 136. The studs 150 are advantageously slideably mounted in groove 152 provided on leg 154 of a T-shaped member 156.

The T-shaped member 156 is secured at the ingress end of the bin by providing a headed stud 160 at the ends of the outward arms 158 of the T-shaped member 156. The studs 160 are seated in one of a plurality of grooves 162 provided on posts or standards 164 at the ingress end of the bin 20. The leg 154 may be provided with a stud 166 which is positioned in hole 168 of a plate 170 secured to the longitudinal member 36 at the ingress end of the bin 20.

As can now be appreciated, the end restraint system can be used with articles stacked in the vertical or horizontal position. Further, the end restraint system of the present invention can be used with a stationary end restraint or an end restraint of the prior art.

DETAILED DESCRIPTION OF THE INVENTION

The invention will now be described for shipping automotive backlites 22 (see FIG. 2) made of ¼ inch (0.63 centimeters) thick tempered glass. The dimension of the bottom edge 48 is about 62 inches (158 centimeters), of the top edge 171 is about 66 inches (168 centimeters and of the sides 52 is about 28 inches (71 centimeters).

With reference to FIG. 1, a bin 20 has a base 24 having dimensions of 75 inches (190 centimeters) by 36 inches (91 centimeters). Right sidewall and left sidewall 28 and 30 have dimensions of 36 inches (91 centimeters), 44 inches (112 centimeters), respectively, and back wall 26 has dimensions of 75 inches (190 centimeters) by 44 inches (112 centimeters). Unless indicated otherwise, all rigid members are made of hollow tubing having a wall thickness of ⅛ inch (0.32 centimeters) square cross-section with dimensions of 2 inches (5.08 centimeters) by 2 inches (5.08 centimeters) securely mounted together as by welding.

The base 24 includes a pair of rigid longitudinal members 34 and 36 joined to ends of rigid lateral members 38, 40 and 42. A pair of stationary runners 44 are spaced about 25 inches (63.5 centimeters) apart about the lateral member 40 of the base 24. Rubber padding 46 is secured to the runners 44 in any conventional manner.

A pair of guide rails 74 made of tubing having a ⅛ inch (0.32 centimeters) wall thickness and a square cross-section having dimensions of 2 inches (5.08 centimeters) by 2 inches (5.08 centimeters) are provided on each side of the base 24. On the right side as viewed in FIG. 1, the guide rails 74 are secured at one end to lateral member 38 and at the other end to adjacent stationary runner 44. On the left side, the guide rails 74 are secured at one end to lateral member 42 and at the other end to adjacent stationary runner 44. The guide rails 74 are spaced about 24 inches (60.5 centimeters) apart about a center line between longitudinal members 34 and 36.

The guide rails 74 support a carriage 68 for moving end restraints 50 toward and away from the sides 52 of the backlites. The right and left carriage and end restraints 50 are identical in construction. Therefore, the carriage and end restraint on the left side of the bin as viewed in FIG. 1 will be discussed with the understanding that the discussion is applicable to the carriage and end restraint on the right side unless indicated otherwise.

With reference to FIGS. 3 and 4, the carriage 68 includes a sleeve 70 slideably mounted on each of the guide rails 74 and joined together by a rigid member 72. The sleeves are made of steel tubing having a wall thickness of 3/16 inch (0.48 centimeters) thick and a square cross-section having outer dimensions of 2½ inches (6.9 centimeters) by 2½ inches (6.9 centimeters). The sleeves are 8 inches (20 centimeters) in length. The rigid member 72 has a wall thickness of 3/16 inch (0.48 centimeters) and a square cross-section having dimensions of 2½ inches (6.9 centimeters) by 2½ inches (6.9 centimeters).

A steel upright 66 having a generally rectangular shape with a width of 4 inches (10.2 centimeters), a length of 6 inches (15 centimeters and a thickness of ⅜ inch (0.95 centimeters) has its width edge securely mounted to each of the sleeves 70. A generally L-shaped plate 60, ¼ inch (0.64 centimeters) thick has dimensions of approximately 28 inches (71 centimeters) in length, 8 inches (20 centimeters) in width for the long leg and approximately 1 inch (2.54 centimeters) by 28 inches (71 centimeters) for the short leg is provided with a pair of spaced plates 63, ⅜ inch (0.95 centimeters) thick. The spaced plates 63 are pivotally mounted to the uprights 66 at 64 as by pins so that the plate 60 fits the edge contour of the backlites (see FIG. 2). A rubber pad 62, ¼ inch (1.27 centimeters) in thickness and having a durometer reading of 60 is provided on the plate 60 to prevent marring of the backlites.

A threaded shaft 76 having an outside diameter (O.D.) of 1 inch (2.54 centimeters) has an end 78 freely mounted in cross member 42 on the left side of the bin and a similar shaft 74 has an end 78 freely mounted in cross member 38 on the right side of the bin (see FIG. 1). The shaft 74 which is about 23 inches (58 centimeters) in length extends from the cross member 42 through a nut 80 securely mounted on the rigid member 72 and through the rigid member.

To prevent movement of the shaft 76 toward adjacent runner 44 and for rotating the shaft, a washer 82 and a nut 84, respectively, are secured to the end 78 of the shaft as by welding. A nut 86 is secured to the shaft 74 at a point about 4 inches (10 centimeters) from the lateral member 42 to secure 28 disc springs made of chromium, vanadium steel having an O.D. of 2.200 inches (5.59 centimeters) and inside diameter (I.D.) of 1.22 inches (3.10 centimeters) and a thickness of 0.591 inches (1.5 centimeters) on the shaft between the nut 86 and the cross member 42. The springs are of the type sold by E. C. Styberg Engineering Co., Inc., and arranged such that each pair of springs has a concave face opposite each other to provide a bellow type spring as shown in FIGS. 4 and 5.

With this arrangement, the end restraint has a force of about 17,000 pounds (7,711 kilograms) at 75 percent deflection of the springs to dampen longitudinal forces of the backlites as the backlites move along the longitudinal reciprocating path while maintaining the end restraint in engagement with the sides 52 of the backlites 22.

One of the end restraints, e.g., the right end restraint as viewed in FIG. 1 is moved toward its adjacent runner 44 by rotating the nut 84 in a first direction. The right end restraint is positioned about 31 inches (78.7 centimeters) from the center lateral member 40 to seat automotive windshields to be subsequently loaded. The left end restraint is moved away from the adjacent runner 44 by rotating the nut 84 in a second direction.

With reference to FIG. 1, the back wall 26 of the bin 20 is provided with a back restraint member 96 (1) to give the articles packing stability and (2) to absorb oscillatory and lateral forces as the backlites move toward the back wall of the bin during transit. The back restraint 96 is of the type disclosed in the previously mentioned U.S. patent application Ser. No. 488,347 filed even date.

The back support member 96 includes a rigid plate 103 securely mounted on a generally U-shaped member 102 in any conventional manner, e.g., by welding. A resilient pad 104 is advantageously secured to outer surface of the plate 103 to prevent marring of the surface of the article in contact therewith and to dampen oscillatory and lateral forces of the articles as the articles move toward the back wall of the bin. A top strut 106 and a bottom strut 108 are each pivotally mounted at one end to the U-shaped member 102 inserted in holes 128 provided on the U-shaped member 102. Each strut 106 and 108 is mounted at their other end to a U-shaped channel member 120 of the back wall 26 by way of pins 122 mounted in holes 122 provided on U-shaped channel member 120.

The ends of the struts at the U-shaped member 102 are spaced 10 inches (25.4 centimeters) apart and the ends of the struts at the U-shaped channel member are spaced 18 inches (45.7 centimeters) apart.

The bin is now ready for receiving the automotive backlites 22. Approximately 80 backlites are loaded in the bin on an edge 48 and separated by dimpled paper (not shown) to prevent surface marring of adjacent surfaces. After the backlites are loaded, the shaft 76 of the left end restraint member 50 is rotated in a second direction to move the end restraint into contact with the sides 52 of the backlites (see FIG. 2).

The backlites 22 are advantageously secured in the bin with a pneumatic restraint device 136 of the type disclosed in the above-mentioned U.S. patent application Ser. No. 488,851 filed even date.

With reference to FIGS. 1 and 2, the pneumatic restraint device 136 includes an inflatable member 140 having a rigid pad and rubber pad (not shown) on one side and a rigid pad 142 on the other side. A valve 148 is provided on the plate 142 for inflating and deflating the member 140.

A pair of headed studs 150 are provided on the pad 142. A generally, T-shaped member 156 having outer arms 158 and a leg 154 is provided to securely mount the pneumatic restraint device at the ingress end of the bin 20.

The leg 154 of the T-shaped member 156 is provided on one side with a groove 152 having a width less than the head of the studs to slideably mount the pneumatic device on the leg 154. The T-shaped member 156 having the pneumatic restraint device 136 is mounted at the ingress end of the bin by providing headed studs 160 at the ends of the outer legs 158 and a stud 166 at the free end of the leg 154. The headed studs 160 are seated in grooves 162 provided in posts 164 at the ingress end of the bin and the stud 166 is mounted in the hole of a plate 170 mounted to the longitudinal member 36.

The pneumatic restraint device 136 is moved along the groove 152 until the center of resilient pad 146 is about 10 inches (25.4 centimeters) from the top side 172 of the article. Air is moved into the valve to inflate the member 140 to move the pad (not shown) into engagement with the stack of backlites. The inflatable member is inflated to a pressure of about 40 psi. This applies a static force of about 1,200 pounds (544.32 kilograms) to unitize the backlites.

With reference to FIG. 2, during transit, longitudinal forces acting on the backlites are absorbed by the end restraint 50. The backlites are accelerated toward one of the end restraints, e.g., the right end restraint as viewed in FIG. 2. Referring now to FIGS. 3 and 4, when the longitudinal force acting on the backlites overcomes the biasing action of the spring 88, the end restraint moves along the guide rails 74 moving the shaft 76 and nut 86 against the biasing action of the disc springs 88. The springs 88 are urged against the cross member 42 of the sidewall 30 and are compressed which increases the biasing action of the spring. When the biasing action of the spring is greater than the longitudinal force, the springs 88 bias the nut 86 and shaft 76 toward the sides of the backlites moving the backlites back along the longitudinal path against the other end restraint, e.g., the left end restraint as viewed in FIG. 2. The left end restraint dampens the longitudinal force in a similar manner as the right end restraint and urges the backlites toward the right end restraint. In this manner, the longitudinal forces are dampened to prevent damage to the edges 52 of the backlites 22 (see FIG. 2) and to maintain the end restraints in engagement with the sides of the backlites.

Also during shipment, the oscillatory and lateral forces are dampened by the pneumatic restraint device 139 and the back restraint member 96 in a manner disclosed in the above-mentioned U.S. patent application Ser. Nos. 488,851 and 488,347 both filed even date.

What is claimed is:

1. An end restraint for an article shipping bin to prevent longitudinal reciprocal movement of the articles, wherein the bin is of the type having a backwall secured to a base, comprising:

at least one guide rail means mounted on the base generally parallel to the backwall;

carriage means slideably mounted on said guide rail means for reciprocal movement in a first direction toward the center of the base and in a second direction opposite to the first direction;

a rigid plate for engaging the articles mounted on said carriage means;

means acting on said carriage means for moving said carriage means in the first direction to a selected one of a plurality of engaging positions and for moving said carriage means in the second direction; and means for dampening forces acting on said plate as said carriage means moves in the second direction from the selected one of the plurality of positions.

2. The end restraint as set forth in claim 1 wherein said guide rail means includes:

a pair of members mounted to the base in spaced parallel relationship to each other and to the back wall; and said carriage means includes a sleeve mounted on each of said spaced members; and a rigid member connecting said sleeves to simultaneously move said sleeves in the first and second directions.

3. The end restraint as set forth in claim 1 wherein said dampening means includes:

a shaft having one end mounted to said carriage means and the other end mounted for reciprocal movement; and biasing means mounted on said shaft, said biasing means being compressed when said carriage moves in the second direction to dampen the forces acting to move the carriage in the second direction.

4. The end restraint as set forth in claim 1 wherein said rigid plate is pivotally mounted on said carriage means.

5. The end restraint as set forth in claim 1 wherein said at least one guide rail means is generally parallel to the backwall and lies in a generally horizontal plane.

6. The end restraint as set forth in claim 1 wherein the articles are loose glass sheets.

7. The end restraint as set forth in claim 1 wherein the articles are loose glass sheets supported in a generally vertical position by the base and backwall and said plate engages side portions of the sheets.

8. The end restraint as set forth in claim 1 wherein said moving means includes:

a threaded shaft having one end rotatably mounted and the other end threaded to said carriage means wherein rotating said threaded shaft in a first direction moves said carriage means in the first direction and rotating said threaded shaft in a second direction moves said carriage in the second direction.

9. The end restraint as set forth in claim 8 wherein the one end of said threaded shaft is rotatably and slideably mounted.

10. End restraints for an article shipping bin to prevent longitudinal reciprocal movement of the articles, the bin is of the type having a base and a back wall wherein the base comprises a pair of longitudinal members joined by a first and second lateral member to form a generally rectangular base, comprising:

a first pair of rigid members having one end secured to the first lateral member and extending toward the center of the base in generally parallel relationship to the pair of longitudinal members;

a second pair of rigid members having one end secured to the second lateral member and extending toward the center of the base in generally parallel relationship to the pair of longitudinal members;

means mounted to the other end of said first and second pairs of rigid members for maintaining said first and second pairs of rigid members on the base;

a sleeve slideably mounted on each of the rigid members of said first and second pair of rigid members;

a first rigid cross member interconnected to said sleeves mounted on said first pair of rigid members to form a first carriage;

a first plate mounted to the first carriage;

a second rigid cross member interconnected to said sleeves mounted on said second pair of rigid members to form a second carriage;

a second plate mounted to the second carriage;

a first threaded shaft having one end threaded to said first rigid cross member and the second end mounted in the first lateral member for rotational and reciprocal longitudinal movement wherein rotating said first shaft in a first direction moves the carriage away from the first lateral member and rotating said shaft in a second direction moves the carriage toward the first lateral member;

a second threaded shaft having one end threaded to said first rigid cross member and the second end mounted in the second lateral member for rotational and reciprocal longitudinal movement wherein rotating said second shaft in a first direction moves the carriage away from the second lateral member and rotating said second shaft in a second direction moves the carriage toward the second lateral member;

a first spring means mounted on said first shaft between said first lateral member and said first carriage wherein forces applied to said first plate by the articles compresses said first spring means to dampen the forces applied to said first plate and to urge said carriage and plate away from the first lateral member; and a second spring means mounted on said second shaft between the second lateral member and said second carriage wherein forces applied to said second plate by the articles compresses said second spring means to dampen the forces applied to said second plate and to urge said carriage and plate away from the second lateral member.

11. The end restraints as set forth in claim 10 wherein the articles are loose glass sheets supported in a generally vertical position by the base and backwall and further including:

said plates pivotally mounted on their respective one of said carriages and said plates engaging sides of the glass sheets as said carriages are moved in the first direction.

* * * * *